US007562723B2

(12) United States Patent
Reitsma

(10) Patent No.: US 7,562,723 B2
(45) Date of Patent: Jul. 21, 2009

(54) METHOD FOR DETERMINING FORMATION FLUID ENTRY INTO OR DRILLING FLUID LOSS FROM A BOREHOLE USING A DYNAMIC ANNULAR PRESSURE CONTROL SYSTEM

(75) Inventor: Donald G. Reitsma, Katy, TX (US)

(73) Assignee: At Balance Americas, LLC, Houston, TX (US)

( * ) Notice: Subject to any disclaimer, the term of this patent is extended or adjusted under 35 U.S.C. 154(b) by 79 days.

(21) Appl. No.: 11/649,567

(22) Filed: Jan. 4, 2007

(65) Prior Publication Data

US 2007/0151762 A1 Jul. 5, 2007

Related U.S. Application Data

(60) Provisional application No. 60/756,311, filed on Jan. 5, 2006.

(51) Int. Cl.
*E21B 21/08* (2006.01)
*E21B 7/00* (2006.01)

(52) U.S. Cl. ..... 175/72; 175/25; 175/38; 175/48; 175/217; 175/218

(58) Field of Classification Search ..... 175/25, 175/38, 48, 72, 66, 213, 217, 218
See application file for complete search history.

(56) References Cited

U.S. PATENT DOCUMENTS

| | | | | |
|---|---|---|---|---|
| 3,614,761 | A * | 10/1971 | Rehm et al. | 367/83 |
| 4,355,784 | A * | 10/1982 | Cain | 251/63 |
| 4,630,675 | A * | 12/1986 | Neipling et al. | 166/53 |
| 6,394,195 | B1 * | 5/2002 | Schubert et al. | 175/69 |
| 6,527,062 | B2 * | 3/2003 | Elkins et al. | 175/25 |
| 6,820,702 | B2 | 11/2004 | Niedermayr et al. | |
| 6,904,981 | B2 * | 6/2005 | van Riet | 175/66 |
| 7,185,719 | B2 * | 3/2007 | van Riet | 175/66 |
| 7,350,597 | B2 * | 4/2008 | Reitsma et al. | 175/66 |
| 2003/0024737 | A1 * | 2/2003 | Chang et al. | 175/25 |
| 2003/0168258 | A1 * | 9/2003 | Koederitz | 175/38 |

(Continued)

FOREIGN PATENT DOCUMENTS

WO WO 03071091 A1 * 8/2003

(Continued)

*Primary Examiner*—David J Bagnell
*Assistant Examiner*—Cathleen R Hutchins
(74) *Attorney, Agent, or Firm*—Richard A. Fagin

(57) ABSTRACT

A method for controlling formation pressure during drilling includes pumping a drilling fluid through a drill string in a borehole, out a drill bit at the end of the drill string into an annular space. The drilling fluid is discharged from the annular space proximate the Earth's surface. At least one of a flow rate of the drilling fluid into the borehole and a fluid flow rate out of the annular space is measured. Pressure of the fluid in the annular space proximate the Earth's surface and pressure of the fluid proximate the bottom of the borehole are measured. Pressure of the fluid proximate the bottom of the borehole is estimated using the measured flow rate, annular space pressure and density of the drilling fluid. A warning signal is generated if difference between the estimated pressure and measured pressure exceeds a selected threshold.

3 Claims, 8 Drawing Sheets

U.S. PATENT DOCUMENTS

| | | | | |
|---|---|---|---|---|
| 2003/0196804 | A1* | 10/2003 | van Riet | 166/267 |
| 2004/0144565 | A1* | 7/2004 | Koederitz | 175/25 |
| 2004/0178003 | A1* | 9/2004 | van Riet | 175/57 |
| 2005/0092523 | A1* | 5/2005 | McCaskill et al. | 175/38 |
| 2005/0269135 | A1* | 12/2005 | Swartout | 175/66 |
| 2006/0070772 | A1* | 4/2006 | deBoer | 175/70 |
| 2006/0113110 | A1* | 6/2006 | Leuchtenberg | 175/38 |
| 2006/0124352 | A1* | 6/2006 | Krueger et al. | 175/25 |
| 2006/0175090 | A1* | 8/2006 | Reitsma et al. | 175/25 |
| 2006/0207795 | A1* | 9/2006 | Kinder et al. | 175/38 |
| 2007/0151763 | A1* | 7/2007 | Reitsma et al. | 175/48 |

FOREIGN PATENT DOCUMENTS

| | | | |
|---|---|---|---|
| WO | WO 2004074627 | A1 * | 9/2004 |

* cited by examiner

METHOD FOR DETERMINING FORMATION FLUID ENTRY INTO OR DRILLING FLUID LOSS FROM A BOREHOLE USING A DYNAMIC ANNULAR PRESSURE CONTROL SYSTEM

CROSS-REFERENCE TO RELATED APPLICATIONS

Priority is claimed from U.S. Provisional Application No. 60/756,311 filed on Jan. 5, 2006.

STATEMENT REGARDING FEDERALLY SPONSORED RESEARCH OR DEVELOPMENT

Not applicable.

BACKGROUND OF THE INVENTION

1. Field of the Invention

The invention relates generally to the field of drilling boreholes using dynamic annular pressure control devices. More specifically, the invention relates to method for determining borehole fluid control events, such as loss of drilling fluid or formation fluid entry into a borehole when such devices are used.

2. Background Art

The exploration for and production of hydrocarbons from subsurface Earth formations ultimately requires a method to reach and extract the hydrocarbons from the formations. The reaching and extracting are typically performed by drilling a borehole from the Earth's surface to the hydrocarbon-bearing Earth formations using a drilling rig. In its simplest form, a land-based drilling rig is used to support a drill bit mounted on the end of a drill string. The drill string is typically formed from lengths of drill pipe or similar tubular segments connected end to end. The drill string is supported by the drilling rig structure at the Earth's surface. A drilling fluid made up of a base fluid, typically water or oil, and various additives, is pumped down a central opening in the drill string. The fluid exits the drill string through openings called "jets" in the body of the rotating drill bit. The drilling fluid then circulates back up an annular space formed between the borehole wall and the drill string, carrying the cuttings from the drill bit so as to clean the borehole. The drilling fluid is also formulated such that the hydrostatic pressure applied by the drilling fluid is greater than surrounding formation fluid pressure, thereby preventing formation fluids from entering into the borehole.

The fact that the drilling fluid hydrostatic pressure typically exceeds the formation fluid pressure also results in the fluid entering into the formation pores, or "invading" the formation. To reduce the amount of drilling fluid lost through such invasion, some of the additives in the drilling fluid adhere to the borehole wall at permeable formations thus forming a relatively impermeable "mud cake" on the formation walls. This mud cake substantially stops continued invasion, which helps to preserve and protect the formation prior to the setting of protective pipe or casing in the borehole as part of the drilling process, as will be discussed further below. The formulation of the drilling fluid to exert hydrostatic pressure in excess of formation pressure is commonly referred to as "overbalanced drilling."

The drilling fluid ultimately returns to the surface, where it is transferred into a mud treating system, generally including components such as a shaker table to remove solids from the drilling fluid, a degasser to remove dissolved gases from the drilling fluid, a storage tank or "mud pit" and a manual or automatic means for addition of various chemicals or additives to the fluid treated by the foregoing components. The clean, treated drilling fluid flow is typically measured to determine fluid losses to the formation as a result of the previously described fluid invasion. The returned solids and fluid (prior to treatment) may be studied to determine various Earth formation characteristics used in drilling operations. Once the fluid has been treated in the mud pit, it is then pumped out of the mud pit and is pumped into the top of the drill string again.

The overbalanced drilling technique described above is the most commonly used formation fluid pressure control method. Overbalanced drilling relies primarily on the hydrostatic pressure generated by the column of drilling fluid in the annular space ("annulus") to restrain entry of formation fluids into the borehole. By exceeding the formation pore pressure, the annulus fluid pressure can prevent sudden influx of formation fluid into the borehole, such as gas kicks. When such gas kicks occur, the density of the drilling fluid may be increased to prevent further formation fluid influx into the borehole. However, the addition of density increasing ("weighting") additives to the drilling fluid: (a) may not be rapid enough to deal with the formation fluid influx; and (b) may cause the hydrostatic pressure in the annulus to exceed the formation fracture pressure, resulting in the creation of fissures or fractures in the formation. Creation of fractures or fissures in the formation typically results in drilling fluid loss to the formation, possibly adversely affecting near-borehole permeability of hydrocarbon-bearing formations. In the event of gas kicks, the borehole operator may elect to close annular sealing devices called "blow out preventers" (BOPs) located below the drilling rig floor to control the movement of the gas up the annulus. In controlling influx of a gas kick, after the BOPs are closed, the gas is bled off from the annulus and the drilling fluid density is increased prior to resuming drilling operations.

The use of overbalanced drilling also affects the depths at which casing must be set during drilling operations. The drilling process starts with a "conductor pipe" being driven into the ground. A BOP stack is typically attached to the top of the conductor pipe, and the drilling rig positioned above the BOP stack. A drill string with a drill bit may be selectively rotated by rotating the entire string using the rig kelly or a top drive, or the drill bit may be rotated independent of the drill string using a drilling fluid powered motor installed in the drill string above the drill bit. As noted above, an operator may drill through the Earth formations ("open hole") until such time as the drilling fluid pressure at the drilling depth approaches the formation fracture pressure. At that time, it is common practice to insert and hang a casing string in the borehole from the surface down to the lowest drilled depth. A cementing shoe is placed on the drill string and specialized cement is displaced through the drill string and out the cementing shoe to travel up the annulus and displace any fluid then in the annulus. The cement between the formation wall and the outside of the casing effectively supports and isolates the formation from the well bore annulus. Further open hole drilling can be carried out below the casing string, with the drilling fluid again providing pressure control and formation protection in the drilled open hole below the bottom of the casing. The casing protects the shallower formations from fracturing induced by the hydrostatic pressure of the drilling fluid when the density of the fluid must be increased in order to control formation fluid pressures in deeper formations.

FIG. 1 is an exemplary diagram of the use of drilling fluid density to control formation pressures during the drilling process in an intermediate borehole section. The top horizontal bar represents the hydrostatic pressure exerted by the drilling fluid and the vertical bar represents the total vertical depth of the borehole. The formation fluid (pore) pressure graph is represented by line 10. As noted above, in overbalanced drilling, the drilling fluid density is selected such that its pressure exceeds the formation pore pressure by some amount for reasons of pressure control and borehole stability. Line 12 represents the formation fracture pressure. Borehole fluid pressures in excess of the formation fracture pressure can result in the drilling fluid pressurizing the formation walls to the extent that small cracks or fractures will open in the borehole wall. Further, the drilling fluid pressure overcomes the formation pressure and causes significant fluid invasion. Fluid invasion can result in, among other problems. reduced permeability, adversely affecting formation production. The pressure generated by the drilling fluid and its additives is represented by line 14 and is generally a linear function of the total vertical depth. The hydrostatic pressure that would be generated by the fluid absent any additives, that is by plain water, is represented by line 16.

In an "open loop" drilling fluid system described above, where the return fluid from the borehole is exposed only to atmospheric pressure, the annular pressure in the borehole is essentially a linear function of the borehole fluid density with respect to depth in the borehole. In the strictest sense this is true only when the drilling fluid is static. In reality the drilling fluid's effective density may be modified during drilling operations due to friction in the moving drilling fluid, however, the resulting annular pressure is generally linearly related to vertical depth.

In the example of FIG. 1, the hydrostatic pressure 16 of the drilling fluid and the pore pressure 10 generally track each other in the intermediate section of the borehole to a depth of approximately 7000 feet. Thereafter, the pore pressure 10 (pressure of fluids in the pore spaces of the Earth formations) increases at a rate above that of an equivalent column of water in the interval from a depth of 7000 feet to approximately 9300 feet. Such abnormal formation pressures may occur where the borehole penetrates a formation interval having significantly different characteristics than the prior formation. The hydrostatic pressure 14 maintained by the drilling fluid is safely above the pore pressure prior to about 7000 feet. In the 7000-9300 foot interval, the differential between the pore pressure 10 and hydrostatic pressure 14 is significantly reduced, decreasing the margin of safety during drilling operations. A gas kick in this interval may result if the pore pressure exceeds the hydrostatic pressure, with an influx of fluid and gas into the borehole possibly requiring activation of the BOPs. As noted above, while additional weighting material may be added to the drilling fluid to increase its hydrostatic pressure, such will be generally ineffective in dealing with a gas kick due to the time required to increase the fluid density at the kick depth in the borehole. Such time results from the fact that the drilling fluid must be moved through thousands of feet of drill pipe to even reach the bit depth, let alone begin filling the annulus to increase the hydrostatic pressure in the annulus.

An open loop drilling fluid system is subject to a number of other problems. It will be appreciated that it is necessary to shut off the mud pumps in order to assemble successive drill pipe segments ("joints") to the drill string to increase its length (called "making a connection"), to enable drilling successively deeper Earth formations. When the pumps are shut off, the annular pressure will undergo a negative spike that dissipates as the annular pressure stabilizes. Similarly, when the pumps are turned back on after making a connection, the annular pressure will undergo a positive spike. Such spiking occurs each time a pipe joint is added to or removed from the string. It will be appreciated that these pressure spikes can cause fatigue on the mud cake and borehole wall, and could result in formation fluids entering the borehole or fracturing the formation again leading to a well control event.

To overcome the foregoing limitations of drilling using an open-loop fluid circulating system, there have been developed a number of drilling systems called "dynamic annular pressure control" (DAPC) systems. One such system is disclosed, for example, in U.S. Pat. No. 6,904,981 issued to van Riet and assigned to Shell Oil Company. The DAPC system disclosed in the '981 patent includes a fluid backpressure system in which fluid discharge from the borehole is selectively controlled to maintain a selected pressure at the bottom of the borehole, and fluid is pumped down the drilling fluid return system to maintain annulus pressure during times when the mud pumps are turned off. A pressure monitoring system is further provided to monitor detected borehole pressures, model expected borehole pressures for further drilling and to control the fluid backpressure system.

As may be inferred from the above discussion of fluid influx and fluid loss events, it is important that detection of such events, and corrective actions therefore take place as soon as possible after the beginning of any such event such that the corrective actions are most likely to be effective. This is particularly the case with gas kicks, because as a gas kick flows up the annulus, the hydrostatic pressure due to the intruding gas, is reduced, whereupon the gas increases in volume, thus displacing successively larger volumes of drilling fluid in the annulus. The displacement of drilling fluid results in reduction of hydrostatic pressure on the annulus, further exacerbating the gas expansion in a dangerous cycle. Much work has therefore been devoted to early, accurate detection of well control events. Many of the techniques known in the art for detection of well control events using open loop fluid circulation systems are described, for example, in U.S. Pat. No. 6,820,702 issued to Niedermayr et al. Generally, techniques known in the art for detecting well control events used with open loop fluid circulation systems use differences between fluid flow volume into the borehole and fluid flow out of the borehole to infer the presence of such an event.

What is needed is a method for determining existence of a well control event to be used with a closed loop fluid circulation systems such as DAPC systems.

It will also be appreciated that one embodiment, at least, of a DAPC system shown in the van Riet '981 patent requires a back pressure pump for the times when the rig mud pumps are turned off in order to maintain annulus fluid pressure. It is desirable to have a DAPC system that does not rely on the use of a separate backpressure pump to maintain annulus pressure under all operating conditions.

SUMMARY OF THE INVENTION

One aspect of the invention is method for determining existence of a well control event by controlling formation pressure during the drilling of a borehole through a subterranean formation. A method according to this aspect of the invention includes pumping a drilling fluid through a drill string extended into a borehole, out a drill bit at the bottom end of the drill string, and into an annular space between the drill string and the borehole. The drilling fluid is discharged from the annular space proximate the Earth's surface. Annular space fluid pressure is selectively increased to maintain a selected fluid pressure proximate the bottom of the borehole by applying fluid pressure to the annular space. The selective increasing includes controlling an aperture of an orifice operatively coupled between the annular space and a discharge line. The selected aperture of the orifice is monitored. Existence of a well control event is determined when the aperture changes and the rate of the pumping remains substantially constant.

A method for controlling formation pressure during the drilling of a borehole according to another aspect of the invention includes pumping a drilling fluid through a drill string extended into a borehole, out a drill bit at the bottom end of the drill string, and into an annular space between drill string and the borehole. The drilling fluid is discharged from the annular space proximate the Earth's surface. At least one of a flow rate of the drilling fluid into the borehole and a fluid flow rate out of the annular space is measured. A pressure of the fluid in the annular space proximate the Earth's surface and a pressure of the fluid proximate the bottom of the borehole are measured. A pressure of the fluid proximate the bottom of the borehole is estimated using the measured flow rate, measured annular space pressure and density of the drilling fluid. A warning signal is generated if a difference between the estimated pressure and the measured pressure exceeds a selected threshold.

Other aspects and advantages of the invention will be apparent from the following description and the appended claims.

DETAILED DESCRIPTION

Figure 2A:
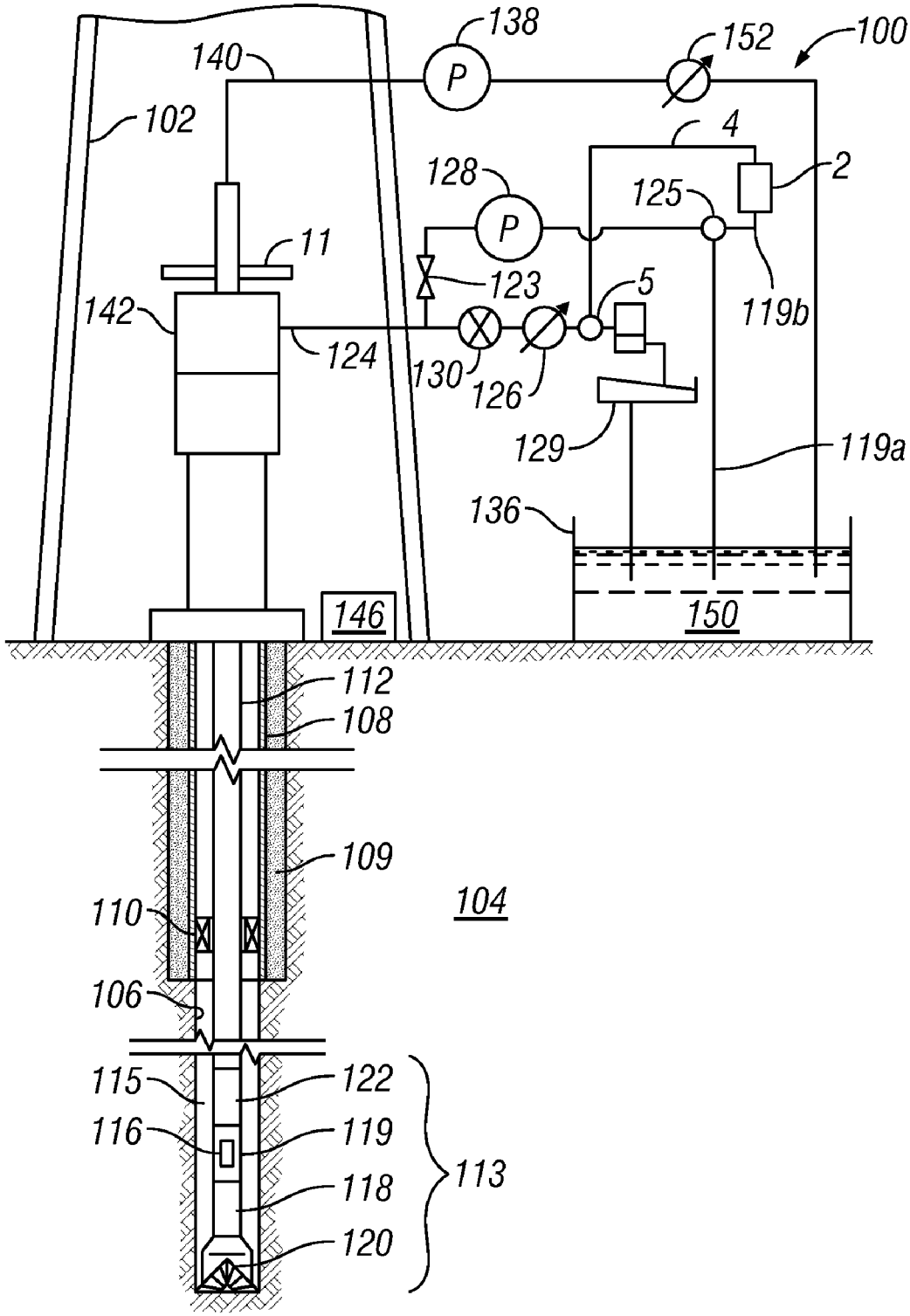
FIGS. 2A and 2B are plan views of two different embodiments of the apparatus that can be use with a method according to the invention.

1. Drilling Circulation System and First Embodiment of a Backpressure Control System FIG. 2A is a plan view depicting a land-based drilling system having one embodiment of a dynamic annular pressure control (DAPC) system that can be used with the invention. It will be appreciated that an offshore drilling system may likewise have a DAPC system using methods according to the invention. The drilling system 100 is shown including a drilling rig 102 that is used to support drilling operations. Many of the components used on the drilling rig 102, such as the kelly, power tongs, slips, draw works and other equipment are not shown separately in the Figures for clarity of the illustration. The rig 102 is used to support a drill string 112 used for drilling a borehole through Earth formations such as shown as formation 104. As shown in FIG. 2A the borehole 106 has already been partially drilled, and a protective pipe or casing 108 set and cemented 109 into place in part of the drilled portion of the borehole 106. In the present embodiment, a casing shutoff mechanism, or downhole deployment valve, 110 is installed in the casing 108 to optionally shut off the annulus and effectively act as a valve to shut off the open hole section of the borehole 106 (the portion of the borehole 106 below the bottom of the casing 108) when a drill bit 120 is located above the valve 110.

The drill string 112 supports a bottom hole assembly (BHA) 113 that can include the drill bit 120, a mud motor 118, a measurement- and logging-while-drilling (MWD/LWD) sensor suite 119 that preferably includes a pressure transducer 116 to determine the annular pressure in the borehole 106. The drill string 112 includes a check valve to prevent backflow of fluid from the annulus into the interior of the drill string 112. The MWD/LWD suite 119 preferably includes a telemetry package 122 that is used to transmit pressure data, MWD/LWD sensor data, as well as drilling information to be received at the Earth's surface. While FIG. 2A illustrates a BHA utilizing a mud pressure modulation telemetry system, it will be appreciated that other telemetry systems, such as radio frequency (RF), electromagnetic (EM) or drill string transmission systems may be used with the present invention.

As noted in the Background section above, the drilling process requires the use of a drilling fluid 150, which is typically stored in a reservoir 136. The reservoir 136 is in fluid communications with one or more rig mud pumps 138 which pump the drilling fluid 150 through a conduit 140. The conduit 140 is connected to the uppermost segment or "joint" of the drill string 112 that passes through a rotating control head or "rotating BOP" 142. A rotating BOP 142, when activated, forces spherically shaped elastomeric sealing elements to rotate upwardly, closing around the drill string 112 and isolating the fluid pressure in the annulus, but still enabling drill string rotation. Commercially available rotating BOPs, such as those manufactured by National Oilwell Varco, 10000 Richmond Avenue, Houston, Tex. 77042 are capable of isolating annular pressures up to 10,000 psi (68947.6 kPa). The fluid 150 is pumped down through an interior passage in the drill string 112 and the BHA 113 and exits through nozzles or jets in the drill bit 120, whereupon the fluid 150 circulates drill cuttings away from the bit 120 and returns the cuttings upwardly through the annular space 115 between the drill string 112 and the borehole 106 and through the annular space formed between the casing 108 and the drill string 112. The fluid 150 ultimately returns to the Earth's surface and goes through a diverter 142, through conduit 124 and various surge tanks and telemetry receiver systems (not shown separately).

Thereafter the fluid 150 proceeds to what is generally referred to herein as a backpressure system 131. The fluid 150 enters the backpressure system 131 and flows through a flowmeter 126. The flow meter 126 may be a mass-balance type or other of sufficiently high-resolution to meter the flow out of the well. Utilizing measurements from the flowmeter 152, a system operator will be able to determine how much fluid 150 has been pumped into the well through the drill string 112. The use of a pump stroke counter may also be used in place of flowmeter 152. Typically the amount of fluid pumped and returned are essentially the same in steady state conditions when compensated for additional volume of the borehole drilled. In compensating for transient effects and the additional volume of borehole being drilled and based on differences between the amount of fluid 150 pumped and fluid 150 returned, the system operator is be able to determine whether fluid 150 is being lost to the formation 104, which may indicate that formation fracturing or breakdown has occurred, i.e., a significant negative fluid differential. Likewise, a significant positive differential would be indicative of formation fluid entering into the borehole 106 from the Earth formations 104.

The returning fluid 150 proceeds to a wear resistant, controllable orifice choke 130. It will be appreciated that there exist chokes designed to operate in an environment where the drilling fluid 150 contains substantial drill cuttings and other solids. Choke 130 is preferably one such type and is further capable of operating at variable pressures, variable openings or apertures, and through multiple duty cycles. The fluid 150 exits the choke 130 and flows through a valve arrangement 5. The fluid 150 can then be processed first by an optional degasser 1 or directly to a series of filters and shaker table 129, designed to remove contaminants, including drill cuttings, from the fluid 150. The fluid 150 is then returned to the reservoir 136. A flow loop 19A, is provided in advance of a valve arrangement 125 for conducting fluid 150 directly to the inlet of a backpressure pump 128. Alternatively, the backpressure pump 128 inlet may be provided with fluid from the reservoir 136 through conduit 119B, which is in fluid communication with the trip tank. The trip tank is normally used on a drilling rig to monitor drilling fluid gains and losses during pipe tripping operations (withdrawing and inserting the full drill string or substantial subset thereof from the borehole). In the invention, the trip tank functionality is preferably maintained. The valve arrangement 125 may be used to select loop 119A, conduit 119B or to isolate the backpressure system. While the backpressure pump 128 is capable of utilizing returned fluid to create a backpressure by selection of flow loop 119A, it will be appreciated that the returned fluid could have contaminants that would not have been removed by filter/shaker table 129. In such case, the wear on backpressure pump 128 may be increased. Therefore, the preferred fluid supply for the backpressure pump 128 is conduit 119A to provide reconditioned fluid to the inlet of the backpressure pump 128.

In operation, the valve arrangement 125 would select either conduit 119A or conduit 119B, and the backpressure pump 128 is engaged to ensure sufficient flow passes through the upstream side of the choke 130 to be able to maintain backpressure in the annulus 115, even when there is no drilling fluid flow coming from the annulus 115. In the present embodiment, the backpressure pump 128 is capable of providing up to approximately 2200 psi (15168.5 kPa) of pressure; though higher pressure capability pumps may be selected at the discretion of the system designer. It can be appreciated that the pump 128 would be positioned in any manner such that it is in fluidic communication with the annulus, the annulus being the discharge conduit of the well.

The ability to provide backpressure is a significant improvement over normal fluid control systems. The pressure in the annulus provided by the fluid is a function of its density and the true vertical depth and is generally by approximation a linear function. As noted above, additives added to the fluid in reservoir 136 must be pumped downhole to eventually change the pressure gradient applied by the fluid 150.

The system can include a flow meter 152 in conduit 100 to measure the amount of fluid being pumped into the annulus 115. It will be appreciated that by monitoring flow meters 126, 152 and thus the volume pumped by the backpressure pump 128, it is possible to determine the amount of fluid 150 being lost to the formation, or conversely, the amount of formation fluid entering to the borehole 106. Further included in the system is a provision for monitoring borehole pressure conditions and predicting borehole 106 and annulus 115 pressure characteristics.

Figure 2B:
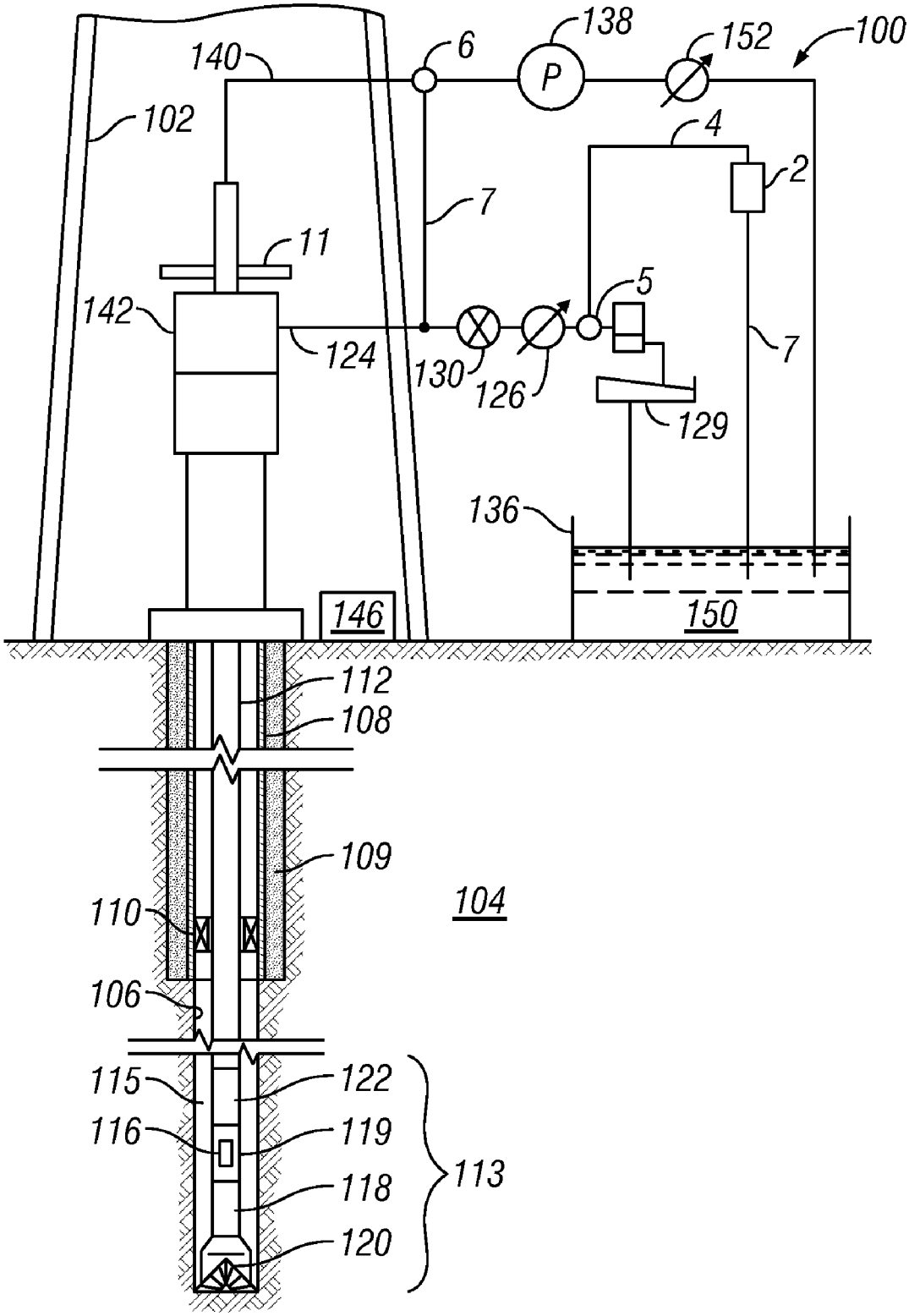

FIG. 2B shows an alternative embodiment of the DAPC system. In this embodiment the backpressure pump is not required to maintain sufficient flow through the choke when the flow through the borehole needs to be shut off for any reason. In this embodiment, an additional valve arrangement 6 is placed downstream of the drilling rig mud pumps 138 in conduit 140. This valve arrangement 6 allows fluid from the rig mud pumps 138 to be completely diverted from conduit 140 to conduit 7, thus diverting flow from the rig pumps 138 that would otherwise enter the interior passage of the drill string 112. By maintaining action of rig pumps 138 and diverting the pumps' 138 output to the annulus 115, sufficient flow through the choke to control annulus backpressure is ensured.

2. DAPC Monitoring System

Figure 3:
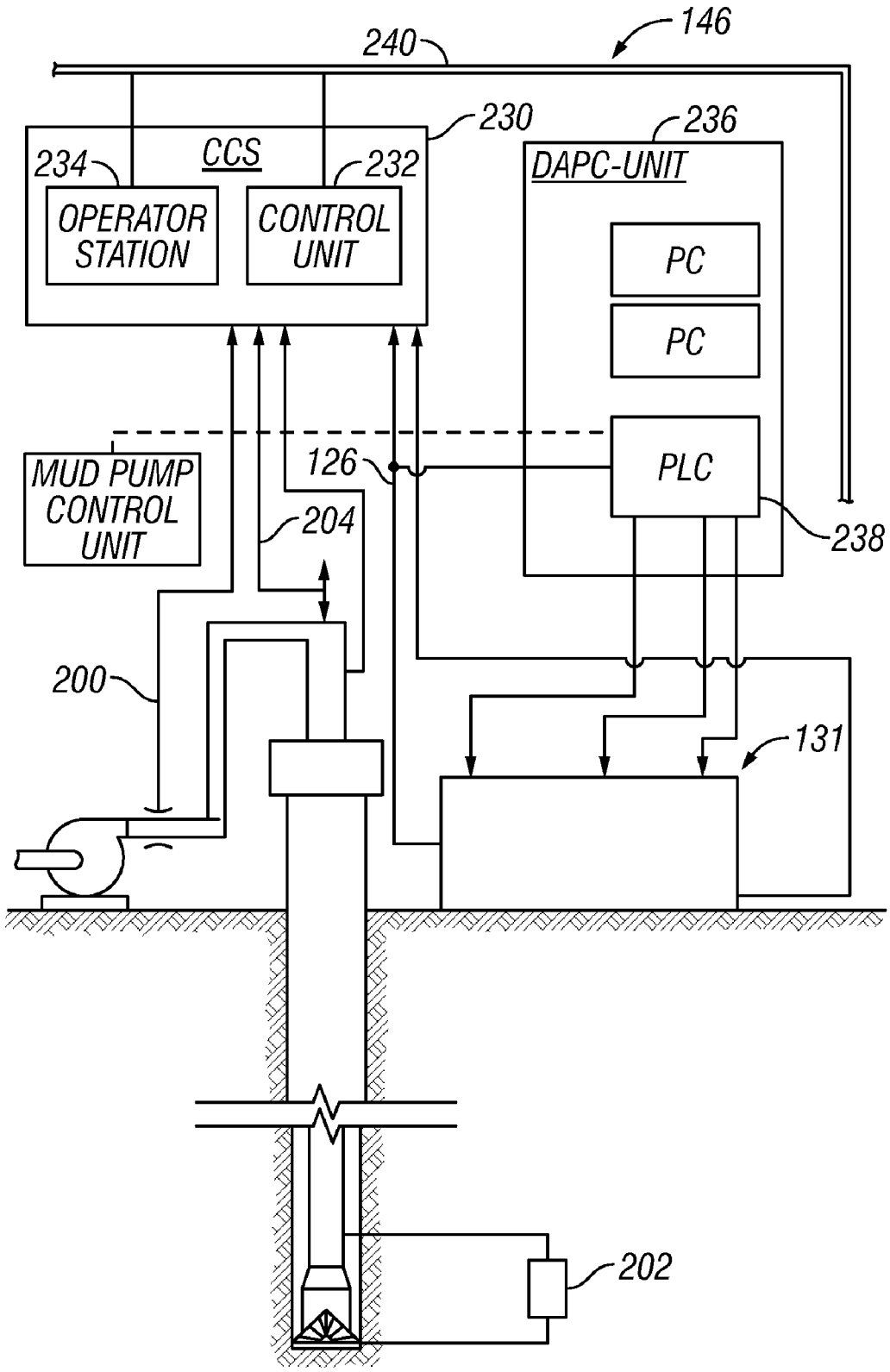
FIG. 3 is a block diagram of the pressure monitoring and control system used in the embodiment shown in FIG. 2.

FIG. 3 is a block diagram of the pressure monitoring system 146 of the DAPC system. System inputs to the pressure monitoring system 146 may optionally include the downhole pressure 202 that has been measured by the appropriate sensor in MWD/LWD sensor package 119, transmitted to the Earth's surface by the MWD telemetry package 122 and received by transducer equipment (not shown) at the Earth's surface. Other system inputs may optionally include pump pressure 200, input flow 204 from flow meter 152 or calculation of the flow rate into the well by calculating the displacement of the pump and rate at which the pump is operating, drilling penetration rate and drill string rotation rate, as well as optionally axial force on the drill bit ("weight on bit" or WOB) and optionally torque on the drill bit (TOB) that may be transmitted from suitable sensors (not shown separately) the BHA 113 depending on the accuracy of the bottomhole pressure measurement required. The return mud flow is measured using optional flow meter 126 where required. Signals representative of the various data inputs are transmitted from a control unit 230 which itself may include a drill rig control unit 232 and a drilling operator's station 234, to a DAPC processor 236 and a back pressure programmable logic controller (PLC) 238, all of which can be connected by a common data network 240. The DAPC processor 236 serves three functions, monitoring the state of the borehole pressure during drilling operations, predicting borehole response to continued drilling, and issuing commands to the backpressure PLC to control the aperture of the choke 130 and to selectively operate the backpressure pump 128. The specific. logic associated with the DAPC processor 236 will be discussed further below.

3. Calculation of Backpressure

Figure 4:
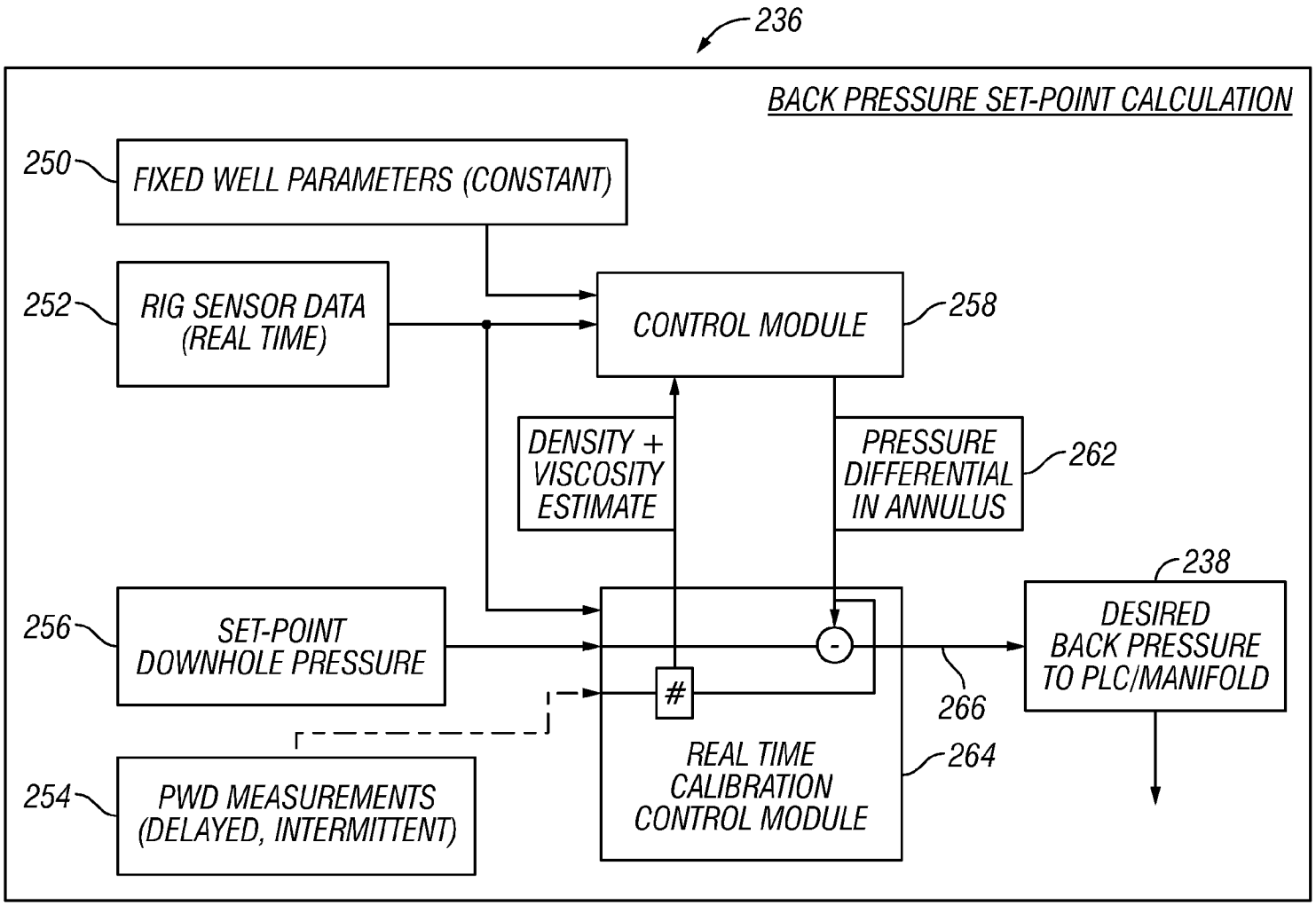
FIG. 4 is a functional diagram of the operation of the pressure monitoring and control system.

A schematic model of the functionality of the DAPC pressure monitoring system 146 is shown in FIG. 4. The DAPC processor 236 includes programming to carry out "Control" functions and "Real Time Model Calibration" functions. The DAPC processor 236 receives data from the various sources and continuously calculates in real time the correct backpressure set-point based on the values of the input parameters. The backpressure set-point is then transferred to the programmable logic controller 238, which generates control signals for the backpressure pump (128 in FIG. 2A) and the choke (130 in FIG. 2A). The input parameters fall into three main groups. The first are relatively fixed parameters 250, including parameters such as borehole and casing string geometry, drill bit nozzle diameters, and borehole trajectory. While it is recognized that the actual borehole trajectory may vary from the planned trajectory, the variance may be taken into account with a correction to the planned trajectory. Also within this group of parameters are temperature profile of the drilling fluid in the annulus (115 in FIG. 2A) and the drilling fluid composition. As with the trajectory parameters, these are generally known and do not substantially change over small portions of the course of the borehole drilling operations. In particular, with the DAPC system, one objective is to be able to keep the bottom hole pressure relatively constant notwithstanding changes in fluid flow rate, by using the backpressure system to provide the additional pressure to control the annulus pressure near to the earth's surface.

The second group of parameters 252 are variable in nature and are sensed and logged substantially in real time. The common data network 240 provides these data to the DAPC processor 236. These data may include flow rate data provided by either of or both the inlet and return flow meters 152 and 126, respectively, the drill string rate of penetration (ROP) or axial velocity, the drill string rotational speed, the drill bit depth, and the borehole depth, the latter two being derived from data from well known drilling rig sensors. The last parameter is the downhole pressure 254 that is provided by the downhole MWD/LWD sensor suite 119 and can be transmitted to the Earth's surface using the mud pulse telemetry package 122. One other input parameter is the set-point downhole pressure 256, or equivalent circulating density at the drill bit, proximate to the drill bit or at some designated point in the bore hole.

Functionally, the control module 258 attempts to calculate the pressure in the annulus (115 in FIG. 2A) at each point over its full borehole length, utilizing various models designed for various formation and fluid parameters. The pressure in the annulus is a function not only of the hydrostatic pressure or weight of the fluid column in the borehole, but includes the pressures caused by drilling operations, including fluid displacement by the drill string, frictional losses due to the flow of fluid returning up the annulus, and other factors. In order to calculate the pressure within the well, the programming in the control module 258 considers the borehole as a finite number of segments, each assigned to a segment of borehole length. In each of the segments the dynamic pressure and the fluid weight (hydrostatic pressure) is calculated and are used to determine the pressure differential 262 for the segment. The segments are then summed and the pressure differential for the entire borehole profile is determined.

It is known that the flow rate of the fluid 150 being pumped into the borehole is related in some respect to the flow velocity of the fluid 150 and the velocity may thus be used to determine dynamic pressure loss as the fluid 150 is being pumped into the borehole through the drill string. The fluid 150 density is calculated in each segment, taking into account the fluid compressibility, estimated drill cuttings loading and the thermal expansion of the fluid 150 for the specified segment, which is itself related to the temperature profile for that segment of the borehole. The fluid viscosity at the estimated temperature for the segment is also important for determining dynamic pressure losses for the segment. The composition of the fluid is also considered in determining compressibility and the thermal expansion coefficient. The drill string rate of axial movement is related to "surge" and "swab" pressures encountered during drilling operations as the drill string is moved into or out of the borehole. The drill string rotation is also used to determine dynamic pressures, as rotation creates a frictional force between the fluid in the annulus and the drill string. The drill bit depth, borehole depth, and borehole and drill string geometry are all used to help generate the borehole segments to be modeled. In order to calculate the density of the fluid, the present embodiment considers not only the hydrostatic pressure exerted by fluid 150, but also the fluid compression, fluid thermal expansion and the drill cuttings loading of the fluid observed during drilling operations. It will be appreciated that the cuttings loading can be determined as the fluid is returned to the surface and reconditioned for further use. All of these factors can be used in calculation of the "static pressure" of the fluid in the annulus.

Dynamic pressure calculation includes many of the same factors in determining static pressure. However, dynamic pressure calculation further considers a number of other factors. Among them is whether the fluid flow is laminar or turbulent. Whether the flow is laminar or turbulent is related to the estimated roughness, borehole size and the flow velocity of the fluid. The calculation also considers the specific geometry for the segment in question. This would include borehole eccentricity and specific drill string segment geometry (e.g. threaded connection or "box/pin" upsets) that affect the flow velocity observed in any segment of the borehole annulus. The dynamic pressure calculation further includes cuttings accumulation in the borehole, as well as fluid rheology and the drill string movement's (axial and rotational) effect on dynamic pressure of the fluid.

It can be appreciated that the nature of the model and the availability of input parameters will affect the relative accuracy of the model, but the principle remains the same.

The pressure differential 262 for the entire annulus is calculated and compared to the set-point pressure 256 in the control module 264. The desired backpressure 266 is then determined and conducted to programmable logic controller 238, which generates control signals for the backpressure pump 128 and the choke 130. Generally, backpressure is increased by reducing the choke aperture. Backpressure is decreased by increasing the choke aperture. As will be explained in more detail below, the particular choke aperture extant at any time can be used as an indicator that a well control event is taking place, namely, that formation fluid is entering the borehole from one or more of the formations (a "kick"), or drilling fluid is leaving the borehole and entering one or more of the formations adjacent to the borehole ("lost circulation").

4. Calibration and Correction of the Backpressure

The above discussion is how backpressure is generally calculated using downhole pressure. This parameter is determined downhole and is typically transmitted up the mud column using mud pressure pulses. Because the data bandwidth for mud pulse telemetry is very low and the bandwidth is also used by other MWD/LWD functions, as well as drill string control functions and downhole pressure, essentially cannot be input to the DAPC model on a real time basis. Accordingly, it will be appreciated that there is likely to be a difference between the measured downhole pressure, when transmitted up to the surface using the mud pulse telemetry, and the predicted downhole pressure for that depth. When such occurs the DAPC system computes adjustments to the parameters and implements them in the model to make a new best estimate of downhole pressure. The corrections to the model may be made by varying any of the variable parameters. In the present embodiment, either of the fluid density and the fluid viscosity are modified in order to correct the predicted downhole pressure to the actual bottomhole pressure. Further, in the present embodiment the actual downhole pressure measurement is used only to calibrate the calculated downhole pressure, rather than to predict downhole annular pressure. With essentially continuous downhole telemetry to enable essentially real-time transmission of the pressure and temperature near the bottom of the borehole, it is then likely practical to include real-time downhole pressure and temperature information to correct the model.

Where there is a delay between the measurement of downhole pressure and other real time inputs, the DAPC control system 236 further operates to index the inputs such that real time inputs properly correlate with delayed downhole transmitted inputs. The rig sensor inputs, calculated pressure differential and backpressure pressures, as well as the downhole measurements, may be "time-stamped" or "depth-stamped" such that the inputs and results may be properly correlated with later received downhole data. Using a regression analysis based on a set of recently time-stamped actual pressure measurements, the model may be adjusted to more accurately predict actual pressure and the required backpressure. In the case where there is no time stamp or depth stamp the same regression analysis process may be used to compare the actual and calculated bottomhole pressure.

Figure 5:
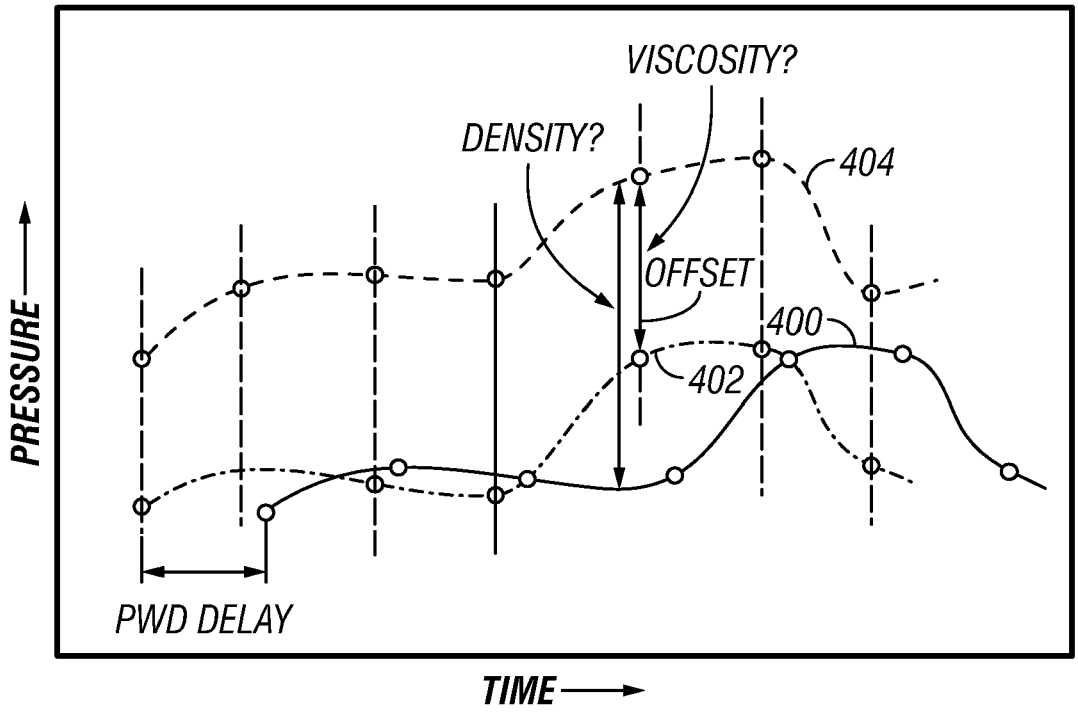
FIG. 5 is a graph showing the correlation of predicted annular pressures to measured annular pressures.

FIG. 5 depicts the operation of the DAPC control system demonstrating an uncalibrated DAPC model. It will be noted that the downhole pressure while drilling (PWD) 400 is shifted in time as a result of the time delay for the signal to be selected and transmitted uphole. As a result, there exists a significant offset between the DAPC predicted pressure 404 and the non-time stamped pressure while drilling or annular pressure (PWD) measurement 400. When the PWD is time stamped and shifted back in time 402, the differential between PWD 402 and the DAPC predicted pressure 404 is significantly less when compared to the non-time shifted PWD 400. Nonetheless, the DAPC predicted pressure differs significantly. As noted above, this differential is addressed by modifying the model inputs for fluid 150 density and viscosity or both.

Figure 6:
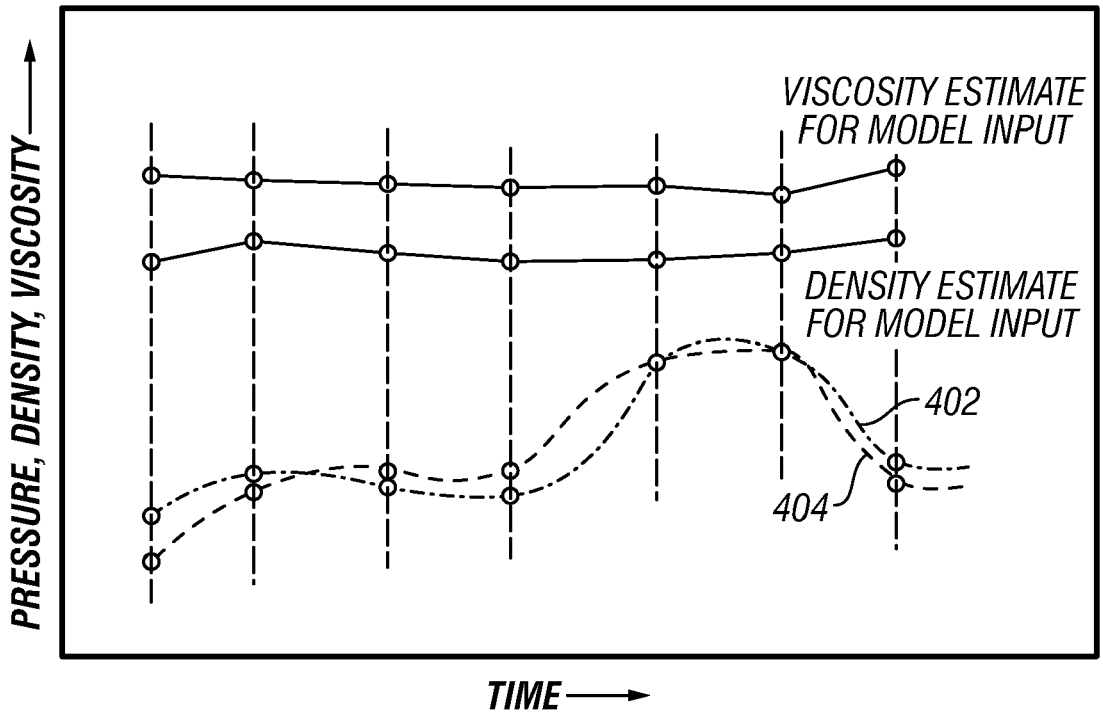
FIG. 6 is a graph showing the correlation of predicted annular pressures to measured annular pressures depicted in FIG. 5, upon modification of certain model parameters.

Based on the new estimates, in FIG. 6, the DAPC predicted pressure 404 more closely tracks the actual bottom hole pressure 402. Thus, the DAPC model uses the actual bottom hole pressure to calibrate the predicted pressure and modify model inputs to more accurately reflect downhole pressure throughout the entire borehole profile.

Based on the DAPC predicted pressure, the DAPC control system 236 will calculate the required backpressure level 266 and transmit it to the programmable logic controller (FIG. 4 238). The programmable controller 238 then generates the necessary control signals to choke 130 necessary valves and backpressure pump 128 as required depending upon the embodiment in use.

In a particular embodiment, calculation of the DAPC system predicted borehole pressure is delayed, after each time the rig mud pumps are started, at least until the pressure of the drilling mud at the mud pump outlet is approximately the same as the backpressure extant at the inlet to the choke. The purpose for the present embodiment is to overcome several adverse artifacts in pressure modeling caused by charging of the mud circulation system after restarting the rig mud pumps. It will be appreciated that when the rig mud pumps are first started, such as after adding a new segment of drill pipe to the drill string ("making a connection"), a substantial quantity of drilling mud will be added to the total drill string and borehole circulation system volume due to the void in the drill string and compression of the mud when it is pressurized by the rig mud pumps to the degree necessary to overcome all the friction in the circulation system. The present embodiment may have particular benefit in the case where a flowmeter is not available in the fluid discharge circuit of the borehole.

5. Applications of the DAPC System

Figure 7:
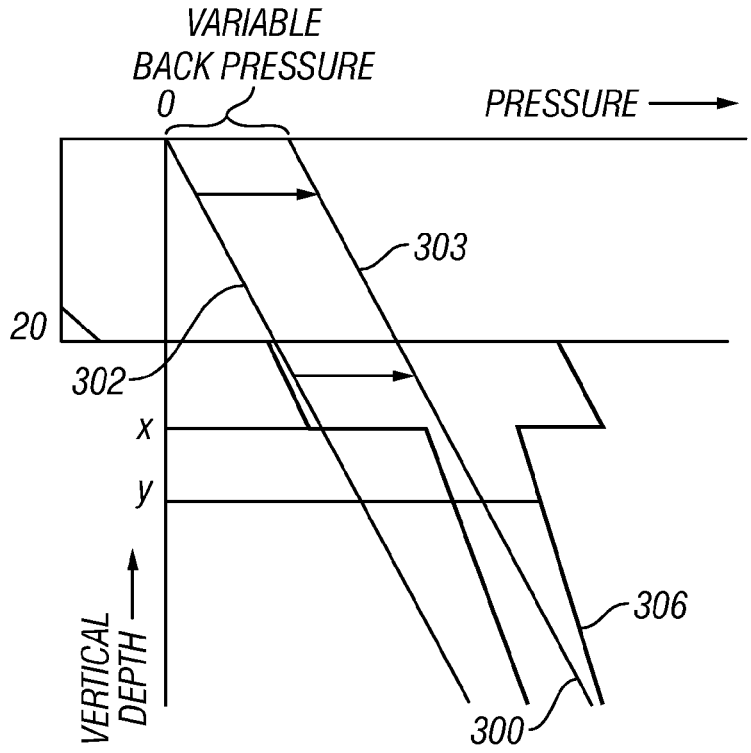
FIG. 7 is a graph showing how the DAPC system may be used to control variations in formation pore pressure in an overbalanced condition.

The advantage in using the DAPC controlled backpressure system may be readily observed in the chart of FIG. 7. The hydrostatic pressure of the fluid is depicted by line 302. As may be seen, the hydrostatic pressure increases as a linear function of the depth of the borehole according to the formula:

$$P=\rho gTVD+C \quad (1)$$

where P is the pressure, ρ is the fluid specific gravity, TVD is the total vertical depth of the borehole, g is the Earth's gravitational constant and C is the backpressure supplied by the backpressure system. In the instance of water gradient hydrostatic pressure 302, the density of the fluid is that of water. Moreover, in an open circulation system, the backpressure C is always zero. In order to ensure that the annular pressure is in excess of the formation pore pressure 300, the fluid is weighted (its density is increased), thereby increasing the pressure applied with respect to the depth in the borehole. The pore pressure profile 300 can be seen in FIG. 7 as being linear, until such time as it exits casing 20, in which instance, it is exposed to the actual formation pressure, resulting in a sudden increase in formation pressure. In normal operations, the fluid density must be selected such that the annular pressure exceeds the formation pore pressure below the casing 20.

Figure 1:
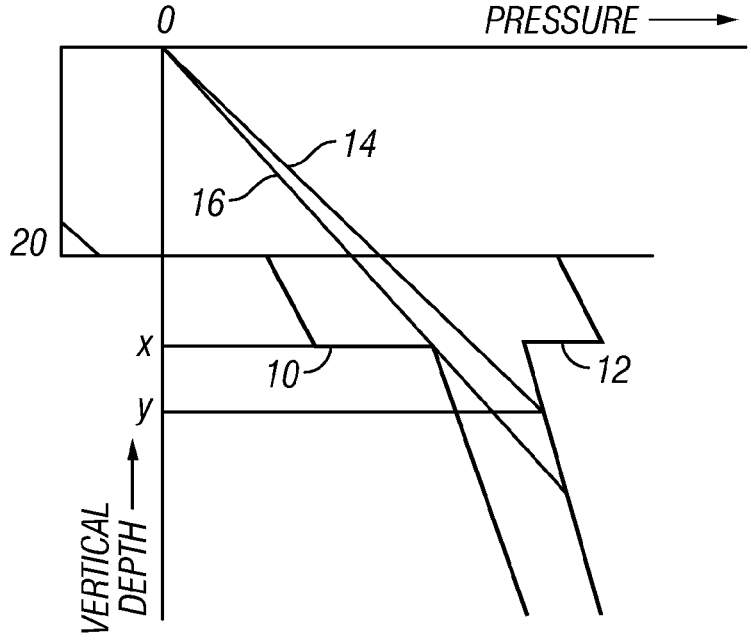
FIG. 1 is a graph depicting annular pressures and formation pore and fracture pressures.

By contrast, the use of the DAPC controlled backpressure system permits an operator to make essentially step changes in the annular pressure. The DAPC pressure lines 303, is shown in FIG. 7 in response to the increase observed in the pore pressure at x the back pressure C may be increased to increase the annular pressure from 300 to 303 in response to increasing pore pressure in contrast with normal annular pressure techniques as depicted in FIG. 1 line 14. The DAPC system further offers the advantage of being able to decrease the back pressure in response to a decrease in pore pressure as shown in 300*c*. It will be appreciated that the difference between the DAPC-maintained annular pressure 303 and the pore pressure 300*c*, known as the overbalance pressure, can be significantly less than the overbalance pressure seen using conventional pressure control methods as will be explained in FIG. 8. Highly overbalanced conditions can adversely affect the formation permeability by forcing greater amounts of borehole fluid into the formation and possibility of not being able to control the fluid loss thereby preventing further drilling of the borehole in a timely and safe manner.

Figure 8:
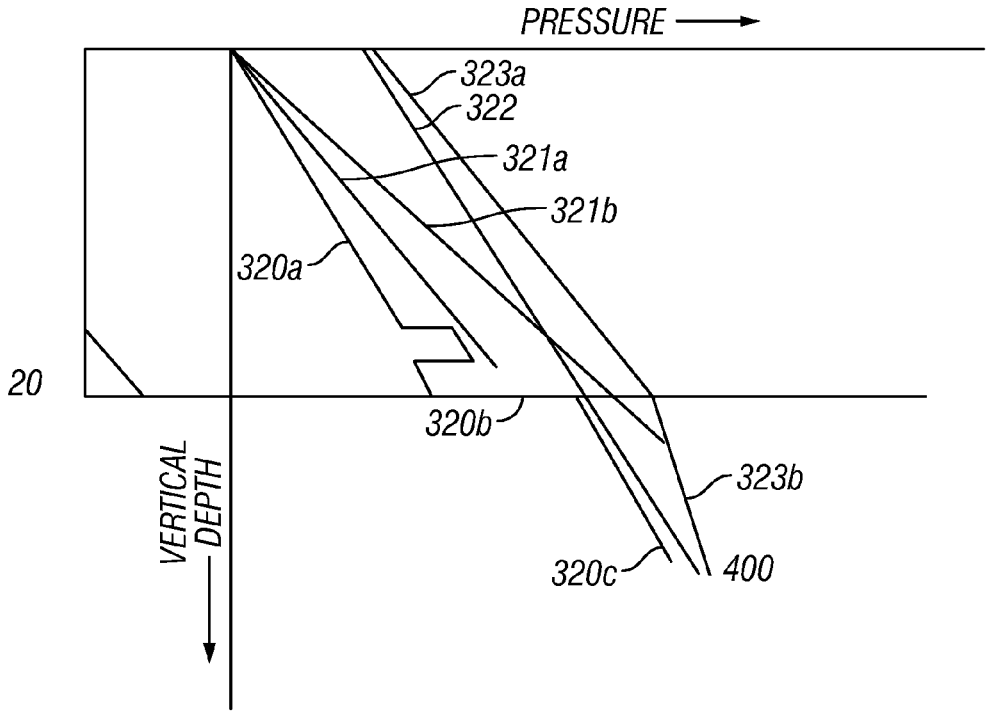
FIG. 8 is a graph depicting DAPC operation as applied to at balanced drilling.

FIG. 8 is a graph depicting one application of the DAPC system in an at-balance drilling (ABD), or near ABD, environment. The situation in FIG. 8 shows the pore pressure gradient in an interval 320*a* as being substantially linear and the fluid in the formations being kept in check by conventional annular pressure 321*a*. A sudden increase in pore pressure occurs, as shown at 320*b*. The normal process would be to set a casing 20 at this point and utilizing pressure control techniques as known in the art, the procedure would be to increase the fluid density to prevent formation fluid influx or borehole instability. The resulting increase in density modifies the pressure gradient of the fluid to that shown at 321*b*. The limit to conventional drilling in this manner is where 321*b* intersects with the reduced fracture gradient 323*b* due limiting the possibility to drill to the planned total depth 400.

Using the DAPC system, the technique to control the borehole in view of the pressure increase observed at 320*b* is to apply backpressure to the fluid in the annulus to shift the entire annulus pressure profile to the right, such that pressure profile 322 more closely matches the pore pressures 320*a* and 320*b* and 320*c* as the well is drilled, as opposed to that presented by pressure profile 321*b*. This method then allows the entire well drilled to the planned total depth 400 without the insertion of casing string 20.

The DAPC system may also be used to control a major well control event, such as a fluid influx. Under methods known in the art, in the event of a large formation fluid influx, such as a gas kick, the only practical borehole pressure control procedure was to close the BOPs to effectively hydraulically "shut in" (seal) the borehole, relieve excess annulus pressure through a choke and kill manifold, and weight up the drilling fluid to provide additional annular pressure. This technique requires time to bring the well under control. An alternative method is sometimes called the "driller's method", which uses continuous drilling fluid circulation without shutting in the borehole. The "Weight and Wait" method involves circulating a supply of heavily weighted fluid, e.g., 18 pounds per gallon (ppg) (3.157 kg/l). When a gas kick or formation fluid influx is detected, the heavily weighted fluid is added and circulated downhole, causing the influx fluid to go into solution in the circulating fluid. The influx fluid starts coming out of solution upon approaching the surface as identified by Boyles Law and is released through the choke manifold. It will be appreciated that while the Driller's method provides for continuous circulation of fluid, it may still require additional circulation time without drilling ahead using the Weight and Wait method to prevent additional formation fluid influx and to permit the formation gas to go into circulation with the now higher density drilling fluid.

Utilizing the present DAPC technique, when a formation fluid influx is detected, the backpressure is increased, as opposed to adding heavily weighted fluid. Like the driller's method, the mud circulation is continued. With the increase in annulus pressure, the formation fluid influx goes into solution in the circulating fluid and is released via the choke manifold. Because the pressure has been increased and it is possible to continue circulating with the additional backpressure, it is no longer necessary to immediately circulate to a heavily weighted fluid. Moreover, as a result of the fact that the backpressure is applied directly to the annulus, the formation fluid is quickly forced to go into solution, as opposed to waiting until the heavily weighted fluid is circulated into the annulus.

Figure 9A:
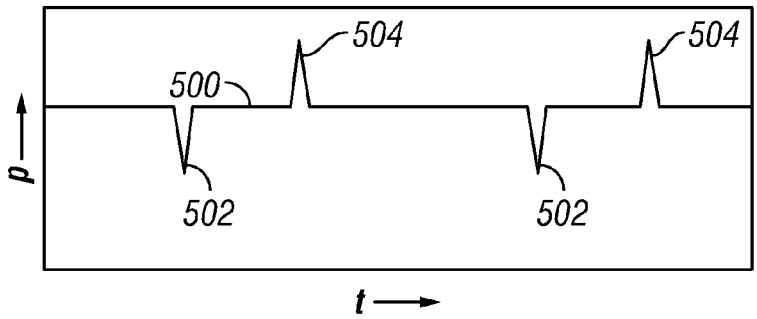
FIGS. 9A and 9B are graphs depicting how the DAPC system may be used to counteract annular pressure drops and spikes that accompany pump off/pump on conditions.
Figure 9B:
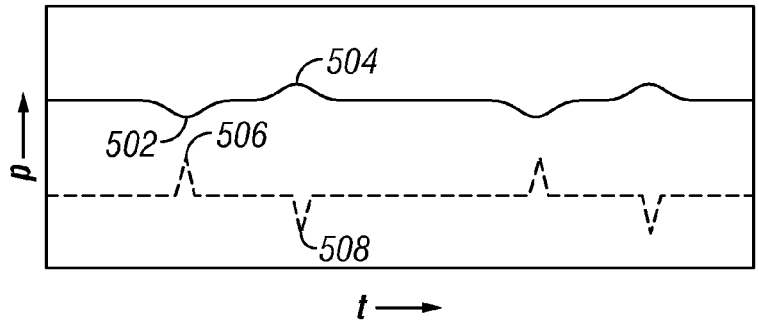

An additional application of the DAPC technique relates to its use in non-continuous circulating systems. As noted above, continuous circulation systems are used to help stabilize the formation, avoiding the sudden pressure 502 drops that occurs when the mud pumps are turned off to make/break new pipe connections. This pressure drop 502 is subsequently followed by a pressure spike 504 when the pumps are turned back on for drilling operations. This is depicted in FIG. 9A. These variations in annular pressure 500 can adversely affect the borehole mud cake, and can result in fluid invasion into the formation. As shown in FIG. 9B, the DAPC system backpressure 506 may be applied to the annulus upon shutting off the mud pumps, ameliorating the sudden drop in annulus pressure from pump off condition to a more mild pressure drop 502. Prior to turning the pumps on, the backpressure may be reduced such that the pump on condition spike 504 is likewise reduced. Thus the DAPC backpressure system is capable of maintaining a relatively stable downhole pressure during drilling conditions.

6. Determining Well Control Events with the DAPC System

Figure 10:
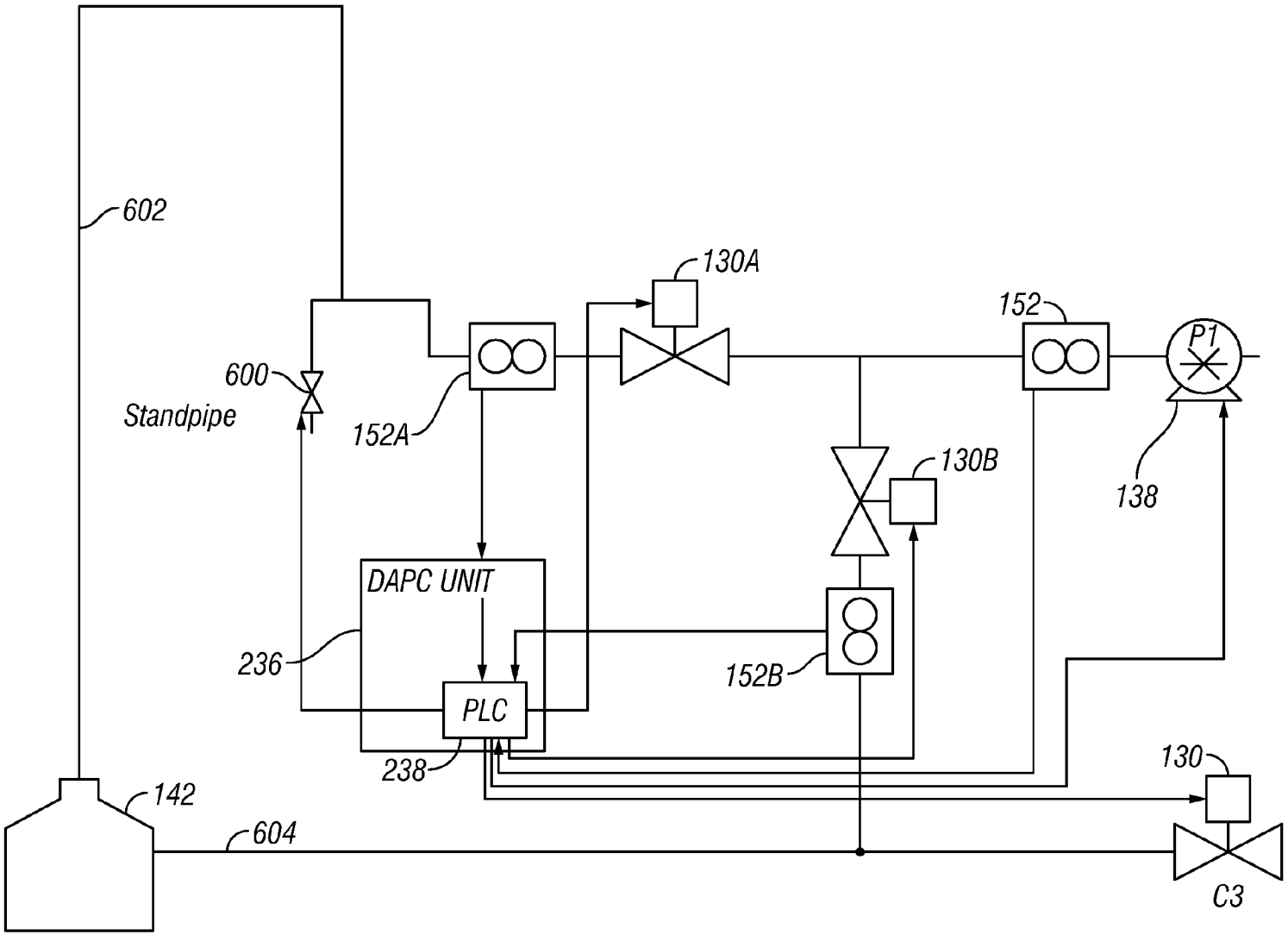
FIG. 10 shows another embodiment of a DAPC system that uses only rig mud pumps for providing selected fluid pressure to both the drill string and the annulus.

It has been determined that a DAPC system such as the one explained above with reference to FIGS. 2A through 9B, and one that will be further explained below with reference to FIG. 10, can be used to determine the existence of well control events. Well control events include influx of fluid from the Earth formations surrounding the borehole, and efflux of fluid in the borehole into the surrounding formations. An influx event (called a "kick") can be detected by comparing the calculated down hole pressure to the actual down hole pressure. Calculating the down hole pressure can be performed using a hydraulics model that determines down hole pressure based on an expected average fluid density in the annulus, usually the density of the drilling fluid as pumped through the drill string. The actual recorded down hole pressure is typically measured near to the drill bit as with an annular pressure sensor or some other form of bottom hole pressure measurement that measures the actual down hole pressure.

Should an influx occur and there is a density contrast between the influx fluid and the drilling fluid that is in the borehole, the model-calculated and the actual borehole down hole pressures will diverge as a result of the difference in the calculated pressure of the column of fluid and the actual pressure as measured, whether the column is static or dynamic. This divergence can be recorded as an error by the DAPC system and corrective action can be taken to maintain the down hole pressure at the desired value (the set point pressure) by either reducing the aperture of the choke if the density of the influx is less than the density of the fluid in the well, or increasing the aperture of the choke somewhat if the density of the influx is greater than the density of the fluid in the well. Change in the choke aperture resulting from such bottom hole pressure differences, when there is no change in the pumped fluid flow rate, is used as an indicator that an influx has taken place.

Another characteristic of an influx is that the choke aperture may increase somewhat due to the increased fluid discharge rate at the Earth's surface, and then stabilize at a new aperture, which may be less, greater or the same as the immediately prior choke aperture, depending on the influx fluid density and friction due to the additional fluid flow. If the influx continues and the density is less than the density of the drilling fluid and the frictional pressure drop is not significant, the average density of the fluid in the borehole will continue to decrease and the choke aperture will continue to close in response to the DAPC system attempting to maintain the down hole pressure at the set point value. Conversely, if the influx fluid density is greater than the borehole fluid density, as fluid influx continues, the density of the fluid column in the borehole annulus will increase, thus causing the DAPC system to continue to increase the choke aperture where the frictional pressure drop is not significant.

The DAPC system determines the new choke aperture based on an adjustment of the predicted down hole pressure with respect to the actual measured down hole pressure. In the case of a lower density fluid influx, the predicted down hole pressure will be less than the previous prediction because the fluid influx has continued to reduce the average density of the column of fluid in the annulus where the frictional pressure drop due to the increased flow as a result of the influx is not sufficient to increase the bottomhole pressure. This will continue to indicate an error and the DAPC system will correct for the error by continuing to close the choke for so long as the influx continues and the average fluid density in well bore continues to decrease. For the case of the influx fluid having a higher density than the drilling fluid, for example, influx from a salt water zone when drilling with an oil-based drilling fluid, the DAPC system will open the choke aperture to reduce the surface annulus pressure in order to compensate for the increasing average density of the fluid in the annulus for so long as the influx continues, the average density is increasing and the frictional pressure drop from the influx is not sufficient to increase the bottomhole pressure.

The other case is when the density of the influx is practically equal to the extant borehole fluid density. In this case the choke may open somewhat due to the increase in discharge volume where the frictional pressure drop from the influx is not sufficient to increase the bottomhole pressure and then continue at the new aperture or a new averaged aperture (due to choke aperture fluctuation using the PID controller 238, such fluctuation being typically sinusoidal). The DAPC system will produce an error that the choke aperture has changed without changes calculated by the hydraulics model since the model is using a number of standard parameters to calculate down hole pressure, one of which is flow into the well in the absence of a flow meter 126. So long as the pump rate does not change, or a change in the pump rate has not indicated that the choke aperture is to be changed by the DAPC system, an error will result. Therefore, a sustained increase in choke aperture for no other apparent reason may be inferred to be a kick when the density of the incoming formation fluid is substantially the same as the drilling mud where the borehole geometry is sufficiently large enough and/or the influx rate is sufficiently low enough to not cause a significant increase in bottomhole pressure due to increased friction in the borehole.

The above explanation of operation of the hydraulics model and control over the choke aperture is provided as background to various well control event detection and mitigation methods that may be performed using the DAPC system. In one method, the aperture of the choke as controlled by the DAPC system is monitored. The aperture may be monitored, for example, by a position sensor coupled to the choke control element. One type of position sensor that may be suited for use with the DAPC system is a linear variable differential transformer (LVDT). If the choke aperture is changed by the DAPC system for more than a transitory period of time in the absence of any change in fluid flow rate into the well and any change in the pressure of the fluid as it is pumped into the well, measurement of such change in aperture may be used to identify a fluid influx or fluid loss event in the well as explained above.

Other implementations of a DAPC system may provide for automatic control over the aperture of the choke but with no measurement related to what the choke aperture actually is. In such implementations, there is no provision to monitor the position of the choke aperture control. In such implementations, it is possible to infer existence of a fluid influx or fluid loss event without a specific measurement related to the position of the choke aperture control. In such implementations, at least one of the flow rate into the well and the flow rate out of the well is measured. The actual bottom hole fluid pressure is also measured, such as with an annular pressure sensor disposed in an instrument positioned in the drill string near to the bottom of the drill string.

In one example, the fluid flow rate into the wellbore is measured, and the fluid pressure on the wellbore annulus at or near the Earth's surface is measured. An expected bottom hole fluid pressure is calculated using the hydraulics model that operates with the DAPC system. Inputs to the bottom hole pressure calculation include the fluid density (mud weight), the fluid flow rate and the annulus pressure at or near the surface. In the event the measured bottom hole pressure differs from the calculated bottom hole pressure, a well influx or fluid loss event may be inferred. The DAPC system may cause the choke aperture to change until the measured bottom hole pressure matches the calculated bottom hole pressure.

Due to the difference in the measured bottom hole pressure and the calculated bottom hole pressure, the DAPC system may automatically change the fluid density (mud weight) entered as input to the hydraulics model such that the measured bottom hole pressure and the calculated bottom hole pressure approximately match. Such change to the input fluid density is provided because neither the fluid flow rate into the wellbore nor the annulus pressure had materially changed during the well control event. Thus, to make the calculated bottom hole pressure match the measured bottom hole pressure, it is necessary to change at least one of the input fluid density and the fluid flow rate. In one embodiment if a change in at least one the fluid density and the fluid flow rate entered as an input to the hydraulics model exceeds a selected threshold, the DAPC system may generate a warning signal.

In some embodiments, the DAPC system may change the choke aperture such that the measured bottom hole pressure is moved toward the calculated bottom hole pressure.

In another embodiment, an expected bottom hole pressure may be calculated from the hydraulics model using as input the fluid density (mud weight), the flow rate of the fluid out of the wellbore and the annulus pressure near to the Earth's surface. The calculated bottom hole pressure is compared to the measured bottom hole pressure. If the two pressures differ, the DAPC system may change the input fluid density to the hydraulics model automatically until the pressures approximately match. If the change in fluid density exceeds a selected threshold, then the DAPC system may generate a warning signal. The DAPC system may also operate the choke to cause the measured bottom hole pressure to substantially match the calculated bottom hole pressure.

In another embodiment the DAPC system may change the measured bottomhole pressure until the change in the input fluid density has stabilized.

In another embodiment the DAPC may change the measured bottom hole pressure until it has reached a new set point value.

In any of the foregoing implementations, a warning signal may also be generated if the calculated bottom hole pressure and the measured bottom hole pressure are different by more than a selected threshold.

7. Alternative Embodiment of Backpressure Control System Using Only Rig Mud Pumps It is also possible to provide selected, controlled annulus fluid pressure without the need for an additional pump to supply back pressure to the annulus when such back pressure must be generated by a pump, as explained above with reference to FIG. 2B. Another embodiment of a backpressure system that uses the rig mud pumps is shown in schematic form in FIG. 10. The rig mud pump(s), shown at 138 discharge drilling mud at selected flow rates and pressures, as is ordinarily performed during drilling operations. In the present embodiment, a first flowmeter 152 may be disposed in the drilling mud flow path downstream of the pump(s) 138. The first flowmeter 152 may be used to measure the flow rate of the drilling fluid as it is discharged from the pump(s) 138. Alternatively, a familiar "stroke counter", that estimates mud discharge volume by monitoring movement of the pump(s) may be used to estimate the total flow rate from the pump(s) 138. The drilling fluid flow is then applied to a first controllable orifice choke 130A, the outlet of which is ultimately coupled to the standpipe 602 (which is itself coupled to the inlet to the interior passage in the drill string). During regular drilling operations, the first choke 130A is ordinarily fully opened.

Drilling fluid discharge from the pump(s) 138 is also coupled to a second controllable orifice choke 130B, the outlet of which is ultimately coupled to the well discharge (the annulus 604). As in previously described embodiments, the interior of the well is sealed by a rotating control head or spherical BOP, shown at 142. Not shown in FIG. 10 are the drill string and other components in the well located below the rotating control head 142, because they can be essentially identical to those used in other embodiments, particularly such as shown in FIG. 2. A third controllable orifice choke 130 can be coupled between the annulus 604 and the mud tank or pit (136 in FIG. 2) and controls the pressure at which the drilling mud leaves the well so as to maintain a selected back pressure on the annulus, similarly to what is performed in the previously described embodiments.

The first 130A and second 130B controllable orifice chokes may each include downstream thereof a respective flow meter 152A, 152B. In conjunction with either the stroke counter (not shown) or the first flowmeter 152 on the pump discharge, the flow rate of drilling fluid from the pump(s) 138 into the standpipe and into the annulus may be determined. The flowmeters 152, 152A, 152B are shown as having their respective signal outputs coupled to the PLC 238 in the DAPC unit 236, which may be essentially the same as the corresponding devices shown in FIG. 3. Control outputs from the PLC 238 are provided to operate the three controllable orifice chokes 130, 130A, 130B.

For purposes of making or breaking connections in the drill string during operation, it is necessary to release all the fluid pressure at the top of the drill string, while it may be necessary to continue to maintain fluid pressure to the top of the annulus fluidically connected to the return line 604. To perform the necessary pressure functions, the PLC 238 may operate the first controllable orifice choke 130A to completely close. Then, a bleed off or "dump" valve 600, which may be under operative control of the PLC 238, is opened to release all the drilling fluid pressure. The check valve or one way valve in the drill string retains pressure below it in the drill string. Thus, connections may be made or broken to lengthen or shorten the drill string during drilling operations.

During such connection operations, selected fluid pressure on the annulus is maintained by controlling the operation of the pump(s) 138, and the second 130B and third 130 controllable orifice chokes. Such control may be performed automatically by the PLC 238 except in the case of the pump which may be controlled by the rig operator as it is only necessary to monitor the flow rate from the pump.

During regular drilling operations, the correct fluid pressure is maintained on the annulus line 604 which is fluidically connected to the wellbore annulus, using the same hydraulics model as in the previous embodiments, by selectively diverting a portion of the pump(s) 138 flow into the annulus return line 604 by controlling the orifices of the first 130A and second 130B chokes, and by controlling the necessary backpressure by adjusting the third choke 130. Ordinarily during drilling, the second choke 130B may remain closed, such that back pressure on the well is maintained entirely by control of the orifice of the third choke 130, similar to the manner in which back pressure is maintained according to the previous embodiments. Ordinarily, it is contemplated that the second choke 130B will be opened during connection procedures, similar to the times at which the back pressure pump in the previous embodiments would be operated.

The present embodiment advantageously eliminates the need for a separate pump to maintain back pressure. The present embodiment may have additional advantages over the embodiment shown in FIG. 2B which uses a valve arrangement to divert mud flow from the rig mud pumps to maintain back pressure, the most important of which is that connections can be made without the need to stop the rig mud pumps and accuracy of the fluid measurement while redirecting the flow from the well to the annulus return line to assure the correct backpressure calculation.

Depending on the particular equipment configuration, it may be possible to determine mud flow rate into the annulus return line 604 using the stroke counter (not shown) and the third flowmeter 152B, or using the first and second flowmeters 152, 152A, respectively.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for determining existence of a well control event by controlling formation pressure during the drilling of a borehole through a subterranean formation, comprising:

selectively pumping a drilling fluid through a drill string extended into a borehole, out a drill bit at the bottom end of the drill string, and into an annular space between drill string and the borehole;

discharging the drilling fluid from the annular space proximate the Earth's surface;

selectively increasing annular space fluid pressure to maintain a selected fluid pressure proximate the bottom of the borehole by applying fluid pressure to the annular space, the selective increasing including controlling an aperture of an orifice functionally coupled to an outlet of the annular space;

monitoring the aperture of the orifice; and determining existence of a well control event when the aperture changes and a rate of the selective pumping remains substantially constant.

2. The method of claim 1 wherein the well control event is determined to be an influx of fluid into the wellbore when the aperture changes due to an increase or decrease in the actual bottomhole pressure.

3. The method of claim 1 wherein the well control event is determined to be a loss of fluid from the wellbore when the aperture decreases due to a reduction in the actual bottomhole pressure.

* * * * *